US009108811B1

(12) United States Patent
Walsh et al.

(10) Patent No.: US 9,108,811 B1
(45) Date of Patent: Aug. 18, 2015

(54) VARIABLY CHANGING NIP FEEDING SPEEDS TO MAINTAIN OPTIMAL SHEET BUCKLE

(71) Applicant: Xerox Corporation, Norwalk, CT (US)

(72) Inventors: Martin Richard Walsh, St. Albans (GB); Jeremy Brook Lewis, London (GB); John Kennedy Mangan, St. Albans (GB); Simon Neil Jowett, St. Albans (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/510,414

(22) Filed: Oct. 9, 2014

(51) Int. Cl.

| | |
|---|---|
| ***B65H 9/00*** | (2006.01) |
| ***B65H 7/00*** | (2006.01) |
| ***B65H 5/06*** | (2006.01) |
| ***B65H 7/06*** | (2006.01) |
| ***B65H 7/20*** | (2006.01) |

(52) U.S. Cl.
CPC ..... *B65H 9/002* (2013.01); *B65H 5/068* (2013.01); *B65H 7/00* (2013.01); *B65H 7/06* (2013.01); *B65H 7/20* (2013.01); *B65H 2301/331* (2013.01); *B65H 2301/51212* (2013.01); *B65H 2513/104* (2013.01); *B65H 2513/108* (2013.01)

(58) Field of Classification Search
CPC ..... B65H 43/00; B65H 5/06; B65H 5/062; B65H 9/006; B65H 9/002; B65H 2513/104; B65H 2513/108; B65H 7/00; B65H 2301/5121; B65H 2301/51212; B65H 2301/331
USPC ..... 271/270, 243
See application file for complete search history.

(56) References Cited

U.S. PATENT DOCUMENTS

| | | | | |
|---|---|---|---|---|
| 4,928,141 | A | 5/1990 | Poehlein et al. | |
| 5,050,859 | A | 9/1991 | Paxon | |
| 5,166,735 | A | 11/1992 | Malachowski | |
| 5,465,955 | A * | 11/1995 | Krupica et al. | 271/265.02 |
| 6,055,409 | A | 4/2000 | Richards et al. | |
| 7,006,785 | B2 | 2/2006 | Embry | |
| 7,810,811 | B2 * | 10/2010 | Suzuki et al. | 271/270 |
| 8,155,572 | B2 | 4/2012 | Richards et al. | |
| 8,459,641 | B2 * | 6/2013 | Ishikawa et al. | 271/243 |
| 8,814,161 | B2 * | 8/2014 | Yamakawa et al. | 271/243 |
| 2005/0035536 | A1 * | 2/2005 | Suga et al. | 271/226 |
| 2011/0076035 | A1 | 3/2011 | Iwakawa | |
| 2013/0134663 | A1 * | 5/2013 | Deno | 271/228 |
| 2013/0135699 | A1 * | 5/2013 | Katto et al. | 358/498 |
| 2014/0027972 | A1 * | 1/2014 | Yamagata | 271/10.11 |
| 2015/0028532 | A1 * | 1/2015 | Takahashi | 271/3.15 |

* cited by examiner

*Primary Examiner* — Patrick Cicchino
(74) *Attorney, Agent, or Firm* — Gibb & Riley, LLC

(57) ABSTRACT

Various methods and devices maintain a registration nip and a transfer nip at the same sheet feeding speed when the leading edge of a sheet is between them. These methods and devices create a buckle in the sheet by increasing the sheet feeding speed of the registration nip while maintaining the transfer nip at the original sheet feeding speed during a first portion of when the sheet is simultaneously within the registration nip and the transfer nip. Such methods and devices then decrease the sheet feeding speed of the registration nip after creating the amount of buckle in the sheet and maintain the registration nip and the transfer nip at the same sheet feeding speed to maintain that specific amount of buckle in the sheet during the remaining portion of when the sheet is simultaneously within the registration nip and the transfer nip.

20 Claims, 8 Drawing Sheets

VARIABLY CHANGING NIP FEEDING SPEEDS TO MAINTAIN OPTIMAL SHEET BUCKLE

BACKGROUND

Devices and methods herein generally relate to sheet feeding systems, and more particularly to sheet feeding systems that feed sheets to a printing engine.

Special purpose machines, such as printing devices, that feed individual sheets, such as cut sheets of print media (paper, transparencies, plastic sheets, card stock, etc.) commonly utilize closely spaced opposing rollers (one or more of which may be powered) that form a nip to move the individual cut sheets along a media path. One or more specialized circuits (such as a speed control circuit or other form of special-purpose controller) control the speed at which the nips feed sheets along the media path. Some nips are spaced a distance from each other that is less than the length of the sheets of media being fed along the media path. In such situations, if the sheet feeding speeds of the adjacent closely-spaced nips are not properly controlled, undesirable consequences can occur, such as sheet stretching, sheet buckling, etc., which can result in printing errors, print jams, damage to the nips, etc.

In one example, the speeds of the registration and transfer nips within a printing device should be correctly matched, or image defects can occur. Matching the sheet feeding speeds of the nips and the mechanical design can alleviate such problems; although, this may result in a system that is very hard to control precisely. If the sheet feeding speeds are not well matched, such devices cannot guarantee that they will always meet image quality targets. More specifically, such systems are very sensitive to hardware variation, and if tolerances such as roll diameters and media path lengths are not properly controlled, errors can occur.

SUMMARY

Various methods herein feed sheets of media along a sheet path to a printing engine. The printing engine comprises a first nip (e.g., registration nip) at a first location of the sheet path, and a second nip (e.g., transfer nip) at a second location of the sheet path. For example, the registration nip removes skew to properly align the sheet edges parallel to the sheet path, and the transfer nip transfers marking material to the sheets of media. The distance between the registration nip and the transfer nip is less than the length(s) of sheets the sheet path is designed to accommodate, which results in the sheets of media being simultaneously driven by the registration nip and the transfer nip at certain times when the sheets are traveling along sheet path.

These methods control the sheet feeding speeds of the registration nip and the transfer nip, using a speed control circuit. More specifically, these methods feed a sheet of media from the registration nip to the transfer nip along the sheet path and maintain the registration nip and the transfer nip at a first sheet feeding speed when the leading edge of the sheet of media is between the registration nip and the transfer nip (using the speed control circuit).

However, these methods create (and maintain) a specific amount of buckle in the sheet of media by first increasing the sheet feeding speed of the registration nip to a second sheet feeding speed while maintaining the transfer nip at the first sheet feeding speed during a first portion of when the sheet of media is simultaneously within the registration nip and the transfer nip, using the speed control circuit. Then, after creating the desired amount of buckle in the sheet of media, these methods decrease the sheet feeding speed of the registration nip back to the first sheet feeding speed, using the speed control circuit. Further, these methods maintain both the registration nip and the transfer nip at the first sheet feeding speed during the remaining portion of when the sheet of media is simultaneously within the registration nip and the transfer nip so as to maintain that specific amount of buckle in the sheet of media during the full amount of the remaining portion of when the sheet of media is simultaneously within the registration nip and the transfer nip, again using the speed control circuit.

Thus, methods herein increase the sheet feeding speed of only the registration nip for only a portion of the time when the sheet is simultaneously held by both nips to first create and then maintain a previously established optimum amount of buckle in the sheet. This optimum amount of buckle, is determined by the methods herein empirically or through modeling so that the amount of buckle that will minimize registration drive frequency effects caused by excess tension in the sheet, while at the same time minimizing image defects that result from vibrations in the sheet caused by excess buckle in the sheet.

Printing devices (apparatuses) herein can include, among other components, a printing engine and a sheet path feeding sheets of media to the printing engine. The sheet path can include, for example, various driven nips (closely spaced opposing rollers (one or more of which may be driven by a motor or actuator)) such as a registration nip at a first location of the sheet path, and a transfer nip at a second location of the sheet path. For example, the registration nip removes skew to properly align the sheet edges to be parallel to the sheet path, and the transfer nip transfers marking material (e.g., toners, inks, etc.) to the sheets of media.

The printing devices herein also include at least one speed control circuit that controls the sheet feeding speeds of the registration nip and the transfer nip. In operation, the registration nip feeds a sheet of media to the transfer nip along the sheet path. The speed control circuit maintains the registration nip and the transfer nip at approximately the same speed (e.g., a first sheet feeding speed) when the leading edge of the sheet of media is between the registration nip and the transfer nip (when the sheet of media is being driven only by the registration nip).

The distance between the registration nip and the transfer nip is less than the length(s) of sheets the sheet path is designed to accommodate, which results in the sheets of media sometimes being simultaneously driven by the registration nip and the transfer nip. With methods herein, the speed control circuit creates a specific amount of buckle in the sheet of media by increasing the sheet feeding speed of the registration nip to a second sheet feeding speed while maintaining the transfer nip at the first sheet feeding speed when the sheet of media is simultaneously within the registration nip and the transfer nip. This "second" sheet feeding speed is greater than the "first" sheet feeding speed, which creates the buckle or bend in the sheet as the sheet is fed faster out of the registration nip than it is taken in by the transfer nip.

Then, after creating this specific amount of buckle in the sheet of media, the speed control circuit decreases the sheet feeding speed of the registration nip back to the first sheet feeding speed so that both the registration nip and transfer nip are again at the same approximate speed. Thus, the speed control circuit maintains the registration nip and the transfer nip at the first sheet feeding speed during the remaining portion of when the sheet of media is simultaneously within the registration nip and the transfer nip to maintain the specific amount of buckle present in the sheet of media during the remaining portion of when the sheet of media is simultaneously within the registration nip and the transfer nip. This "remaining" portion of when the sheet of media is simultaneously within the registration nip and the transfer nip occurs from when the process of creating the specific amount of buckle in the sheet of media is complete, until a trailing edge of the sheet of media exits the registration nip.

The speed difference between the relatively slower first sheet feeding speed of the transfer nip and the relatively faster second sheet feeding speed causes the sheet to buckle between the registration nip and the transfer nip when the sheet of media is simultaneously within the registration nip and the transfer nip. For purposes herein, a "buckle" or "bend" within a sheet occurs when at least a portion of the edges of the sheet that are parallel to the direction in which this sheet is being moved along the sheet path become curved (are no longer completely straight). Such a buckle generally occurs in the location of the sheet away from the leading edge and the trailing edge of the sheet.

This intentionally created buckle prevents the sheet from being stretched between the registration nip and the transfer nip, which prevents the transfer nip from spinning against the print media and reduces printing errors. However, excess buckle can undesirably result in vibrations being delivered to the transfer nip, which can also result in printing errors, or excess buckle can cause the sheet to undesirably contact other components of the printing device. Thus, these devices utilize a previously established optimum amount of buckle in the sheet that balances the competing benefits of minimizing tension while avoiding excesses buckling. This "previously established" amount of buckle in the sheet has been previously established (e.g. empirically, or through modeling, etc.) to minimize registration drive frequency effects caused by excess tension in the sheet, while at the same time minimizing image defects resulting from vibrations in the sheet caused by excess buckle in the sheet. Thus, the speed control circuit first speeds up the registration nip to create a specific amount of buckle, and then keeps both the registration nip and transfer nip at the same speed to maintain that amount of buckle in the sheet during the all the remaining time when the sheet of media is simultaneously within the registration nip and the transfer nip.

These and other features are described in, or are apparent from, the following detailed description.

BRIEF DESCRIPTION OF THE DRAWINGS

Various exemplary devices and methods are described in detail below, with reference to the attached drawing figures, in which.

DETAILED DESCRIPTION

Figure 1:
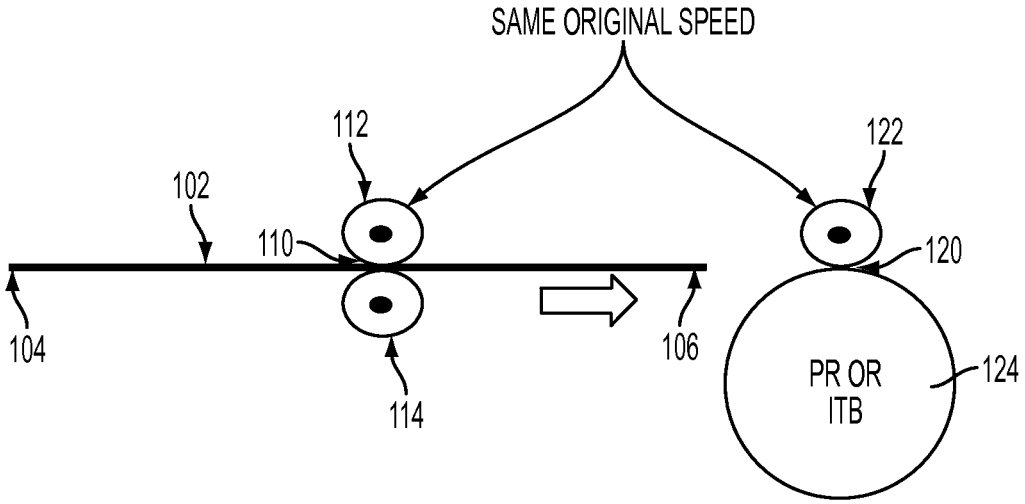
FIG. 1 is a schematic diagram illustrating devices herein.

As mentioned above, if the sheet feeding speeds of the adjacent closely-spaced nips are not properly controlled, undesirable consequences can occur, such as sheet stretching, sheet buckling, etc., which can result in printing errors, print jams, damage to the nips, etc.

Therefore, the devices and methods herein maintain a specific amount of buckle in sheets that are held simultaneously by the registration nip than the transfer nip. With the devices herein, sheets are transferred from the registration rolls to the transfer tip using a nip roller and a drive roller driven by a stepper motor. The transfer nip, photoreceptor, and bias transfer roller (BTR) can be controlled by a constant velocity brushless DC motor, for example. To avoid image defects, the registration nip can be driven faster than the photoreceptor nip so that a buckle is formed in the sheet between the registration and transfer nips, thereby preventing the sheet from being pulled tight (which causes image defects).

Constraints in the media path may only allow for a certain amount of buckle to be formed, and any amount of buckle greater than this may cause image defects at the trail edge of the print media. Image defects may occur if the registration nip speed is too slow or too fast, and such visual defects are exacerbated on long medias. The devices and methods herein actively control the speed of the registration nip stepper motor to maintain the optimum sheet buckle over the period of time that the sheet is being driven simultaneously by the registration nip and the transfer nip.

Therefore, with methods and devices herein, the transfer nip runs at constant velocity as controlled by a brushless DC motor, for example. With devices herein, a hybrid stepper can control the registration nip, allowing the nip speed to be altered as the sheet passes through registration. To achieve an image transferred to the required media a sheet is delivered from the registration nip to the transfer nip. While the image is being transferred from the transfer belt or photoreceptor to the media, the media will be in both the registration nip and the transfer nip until the trailing edge of the print media sheet leaves the registration nip.

As noted above, the media should not be tight between the registration nip and the transfer nip, nor should too much buckle be generated. More specifically, if the media is tight, then registration drive frequency effects can be transferred to the image. Conversely, if the media buckle is too large, then image defects will occur when the media trailing edge leaves the registration nip. To achieve the optimum media buckle between the registration nip and the transfer nip, the sheet feeding speed of only the registration nip is increased for only a portion of the time when the sheet is simultaneously held by both nips, to first create, and then maintain, a previously established optimum amount of buckle in the sheet.

FIGS. 1-6 illustrate portions of printing devices herein. More specifically, as illustrated in FIGS. 1-6 and 9, printing devices (apparatuses) herein can include, among other components, a printing engine 240 and a sheet path 236 feeding sheets of media 102 to the printing engine. The sheet path 236 can include, for example, various driven nips 110, 120 (between closely spaced opposing rollers (one or more of which may be driven by a motor or actuator)) such as a registration nip 110 (first nip) at a first location of the sheet path 236, and a transfer nip 120 (second nip) at a second location of the sheet path 236.

For example, the registration nip 110 is formed between opposing rollers 112, 114, at least one of which is powered by a motor, such as a stepper motor that has the ability to change the rotational speed of one of the rollers 112, 114, thereby changing the sheet forwarding speed of the registration nip 110. As is understood by those ordinarily skilled in the art, the registration nip 110 removes skew to properly align the sheet edges to be parallel to the sheet path 236.

The transfer nip 120 is formed between pressure roller 122 and a transfer device 124 that contains marking material that is to be transferred to the sheet of media 102. For example, the transfer device 124 can comprise a photoreceptor (PR), an intermediate transfer belt (ITB), or any other surface that contains patterned marking material (e.g., toners, inks, etc.) that is to be transferred to the sheet of media 102. The pressure roller 122 or the transfer device 124 can be powered by a motor to provide a sheet feeding speed for the transfer nip 120.

While nips 110 and 120 are referred to herein as transfer and registration nips, respectively, those ordinarily skilled in the art would understand that these nips are only used as examples, and that the methods and devices herein are equally applicable to any closely spaced nips that would benefit from a fed cut sheets maintaining a consistent buckle between such nips. Further, the methods and devices herein are greatly distinguished from systems that feed uncut webs of print media from rolls, because cut sheets have unique issues associated with vibrations and other physical repercussions resulting from rolls contacting the leading and trailing edges of the sheets and continuously fed webs of material do not experience such issues because they do not have leading or trailing edges. Therefore, experiences from the art of continuously fed webs of material are not germane to the art of feeding cut sheets within media paths.

The printing devices herein also include at least one speed control circuit 224 (shown in FIG. 9) that controls the sheet feeding speeds of the registration nip 110 and the transfer nip 120. In operation, the registration nip 110 feeds a sheet of media 102 to the transfer nip 120 along the sheet path 236. As shown in FIG. 1, the speed control circuit 224 maintains the registration nip 110 and the transfer nip 120 at approximately the same speed (e.g., a first sheet feeding speed) when the leading edge 106 of the sheet of media 102 is between the registration nip 110 and the transfer nip 120 (when the sheet of media 102 is being driven only by the registration nip 120).

Figure 2:
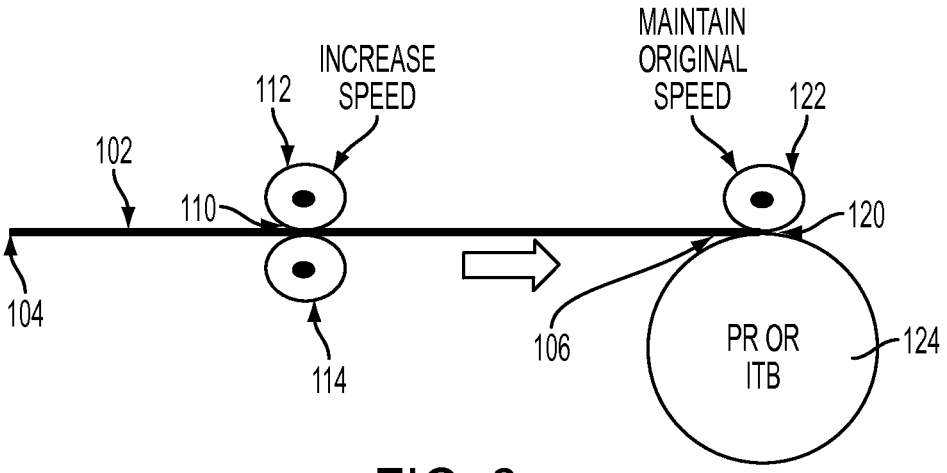
FIG. 2 is a schematic diagram illustrating devices herein.

As shown in FIG. 2, the registration nip 110 is immediately adjacent (e.g., no intervening elements between the two, other than guides, etc.) the transfer nip 120. For example, the distance between the registration nip 110 and the transfer nip 120 is less than the lengths of the various and different sized sheets 102 the sheet path 236 is designed to accommodate, which results in the sheets of media 102 sometimes being simultaneously driven by the registration nip 110 and the transfer nip 120.

With methods herein, the speed control circuit 224 creates a specific amount of buckle in the sheet of media 102 by increasing the sheet feeding speed of the registration nip 110 to a second sheet feeding speed while maintaining the transfer nip 120 at the first sheet feeding speed when the sheet of media 102 is simultaneously within the registration nip 110 and the transfer nip 120. This "second" sheet feeding speed is greater than the "first" sheet feeding speed, which creates the buckle or bend in the sheet as the sheet is fed faster out of the registration nip 110 than it is taken in by the transfer nip 120.

Figure 3:
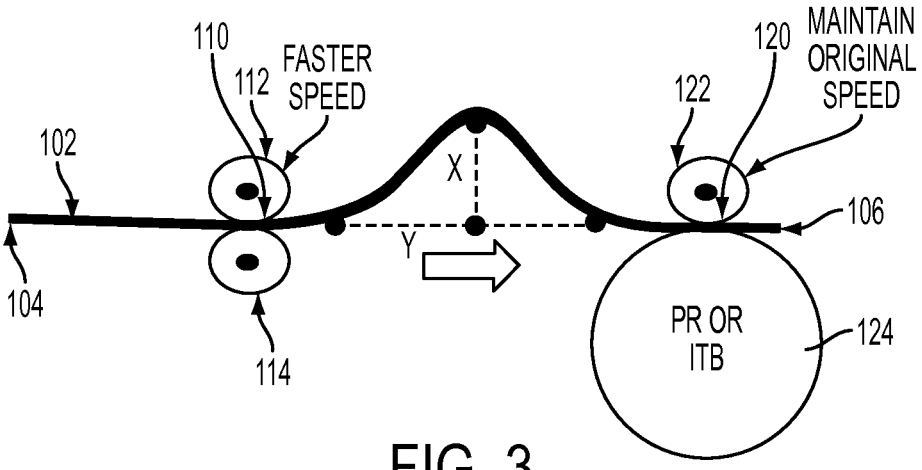
FIG. 3 is a schematic diagram illustrating devices herein.

More specifically, as shown in FIG. 2, as the leading edge 106 of the sheet of media 102 enters the transfer nip 120, the speed control circuit 224 increases the speed of the registration nip 110 relative to the speed of the transfer nip 120 (which maintains the original speed at which it was operating in FIG. 1). Similarly, as shown in FIG. 3, the registration nip 110 is maintained at a higher sheet feeding speed relative to the transfer nip 120 until a buckle or bend (having length Y and height X, for example) is formed in the sheet of media 102 between the registration nip 110 and transfer nip 120. Here Y and X are intended to represent any measures of a buckle that are found to be optimum for a specific device, for a specific size of sheet, for a specific type of media, etc.

Figure 4:
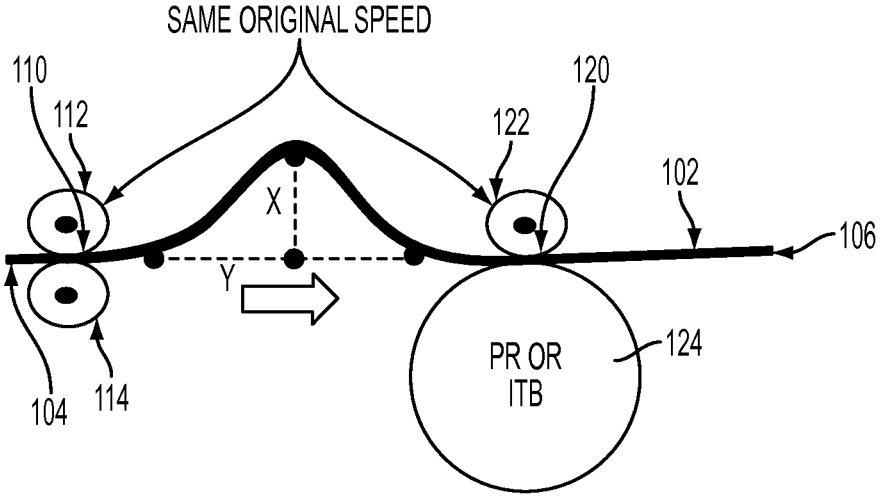
FIG. 4 is a schematic diagram illustrating devices herein.

Then, after creating this specific amount of buckle (consistently having length Y and height X) in the sheet of media 102, as shown in FIG. 4, the speed control circuit 224 decreases the sheet feeding speed of the registration nip 110 back to the first sheet feeding speed so that both the registration nip 110 and transfer nip 120 are again at the same approximate speed.

Figure 5:
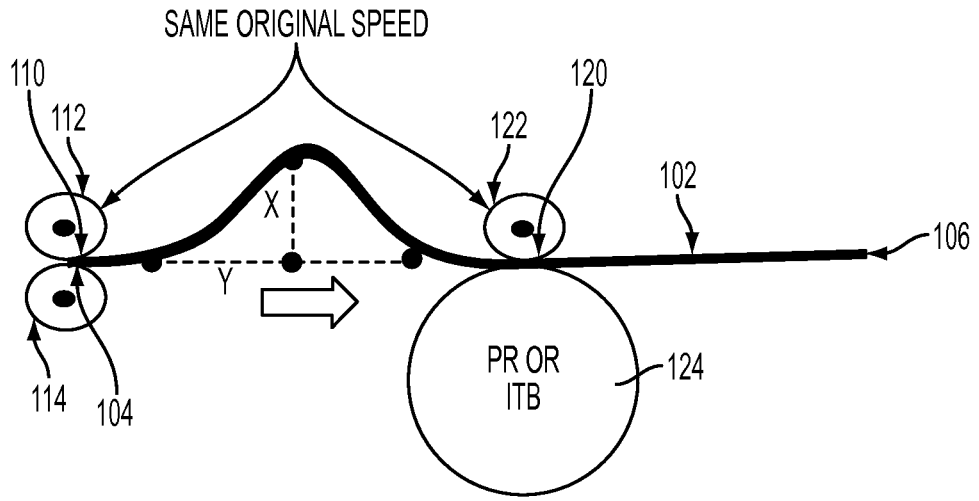
FIG. 5 is a schematic diagram illustrating devices herein.
Figure 6:
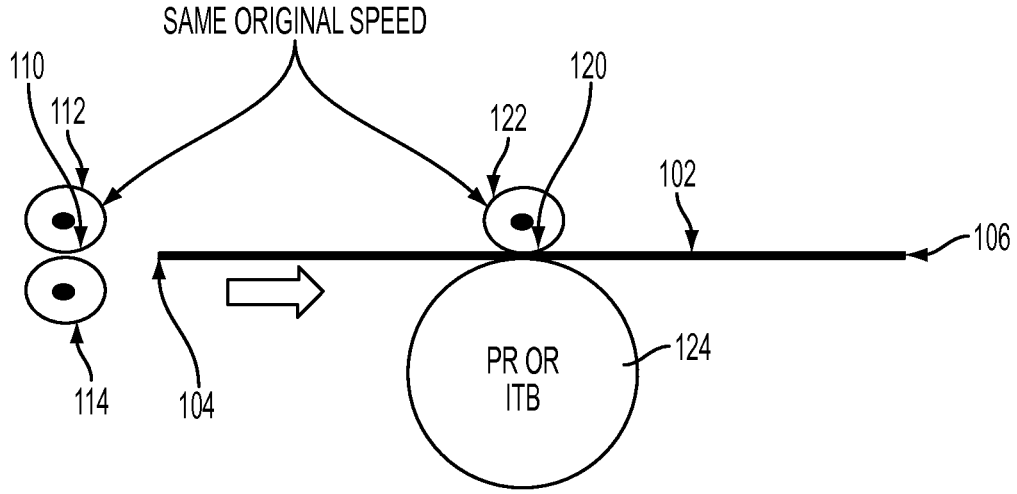
FIG. 6 is a schematic diagram illustrating devices herein.

Thus, in the schematic illustration shown in FIGS. 4-6, after creating this specific amount of buckle (having length Y and height X) in the sheet of media 102, the speed control circuit 224 maintains both the registration nip 110 and the transfer nip 120 at the first sheet feeding speed during the remaining portion of when the sheet of media 102 is simultaneously within the registration nip 110 and the transfer nip 120. This maintains the specific amount of buckle (having length Y and height X) present in the sheet of media 102 during the remaining portion of when the sheet of media 102 is simultaneously within the registration nip 110 and the transfer nip 120.

The "first" portion is when the sheet of media is simultaneously within the registration nip 110 and the transfer nip 120, and when the registration nip 110 is at a relative higher sheet forwarding speed and the buckle is being formed, as shown in FIGS. 2 and 3. The "remaining" portion is when the sheet of media 102 is still simultaneously within the registration nip 110 and the transfer nip 120, and when both nips are at the same sheet forwarding speed. As shown in FIGS. 4 and 5, the remaining portion occurs from when the process of creating the specific amount of buckle in the sheet of media 102 is complete (FIG. 3) until a trailing edge 104 of the sheet of media 102 exits the registration nip 110 (FIG. 6).

The speed difference between the relatively slower first sheet feeding speed of the transfer nip 120 and the relatively faster second sheet feeding speed shown in FIGS. 2 and 3 causes the sheet to buckle between the registration nip 110 and the transfer nip 120 when the sheet of media 102 is simultaneously within the registration nip 110 and the transfer nip 120. For purposes herein, a "buckle" or "bend" within a sheet occurs when at least a portion of the sheet edges that are parallel to the direction in which this sheet is being moved along the sheet path 236 (which is indicated by the block arrow in FIGS. 1-6) become curved and are no longer completely straight or linear. Such a buckle generally occurs in the location of the sheet between from the leading edge 106 and the trailing edge 104 of the sheet.

As noted above, the buckle is formed to specifically have length Y and height X (FIG. 3) and, after that point, both nips are rotated at the same sheet forwarding speed. This maintains the size and shape of the buckle to have length Y and height X until the trailing edge 104 is fed out of the registration nip 110. Further, the methods and speed control circuit 224 herein cause the registration nip 110 to operate at the relatively higher sheet forwarding speed for a specific amount of time (or a specific rotational count of a roller) that will create the buckle to specifically have length Y and height X. For example, the registration nip 110 can be caused to operate at a relatively higher sheet forwarding speed only for the first 1%-70% (e.g., 25%, 40%, 60%, etc.) of the full time that the sheet of media 102 is simultaneously held by both nips 110, 120 to create a specific amount of buckle. Further, this sized and shaped buckle (having length Y and height X) has been previously established to be optimum for a specific printing device.

More specifically, this intentionally created amount of buckle (or buckle shape) prevents the sheet from being stretched between the registration nip 110 and the transfer nip 120, which prevents the transfer nip 120 from spinning against the print media 102 and reduces printing errors. However, excess buckle can undesirably result in vibrations being delivered to the transfer nip 120, which can also result in printing errors, or excess buckle can cause the sheet to undesirably contact other components of the printing device.

Simply maintaining the registration nip 110 always at a higher relative speed to the transfer nip 120 would cause the buckle to constantly grow until the trailing edge 104 of the sheet of media 102 exited the registration nip 110, which could result in a buckle that was too small at certain times and too large at other times. By increasing the speed of the registration nip 110 only a portion of the time that the sheet of media 102 is maintained between the nips 110, 120, the size and shape of the buckle can be maintained consistently for most of the time while the sheet of media 102 is simultaneously within both nips 110, 120.

Thus, these devices and methods create a previously established optimum amount of buckle in the sheet that balances the competing benefits of minimizing tension while avoiding excesses buckling. This "previously established" amount of buckle in the sheet has been previously established (e.g. empirically, through modeling, etc.) to minimize registration drive frequency effects caused by excess tension in the sheet, while at the same time minimizing image defects resulting from vibrations in the sheet caused by excess buckle in the sheet for a given printing device. Thus, the speed control circuit 224 first speeds up the registration nip 110 to create a specific amount of buckle, and then keeps both the registration nip 110 and transfer nip 120 at the same speed to maintain that amount of buckle in the sheet during all the remaining time when the sheet of media 102 is simultaneously within the registration nip 110 and the transfer nip 120.

Figure 7:
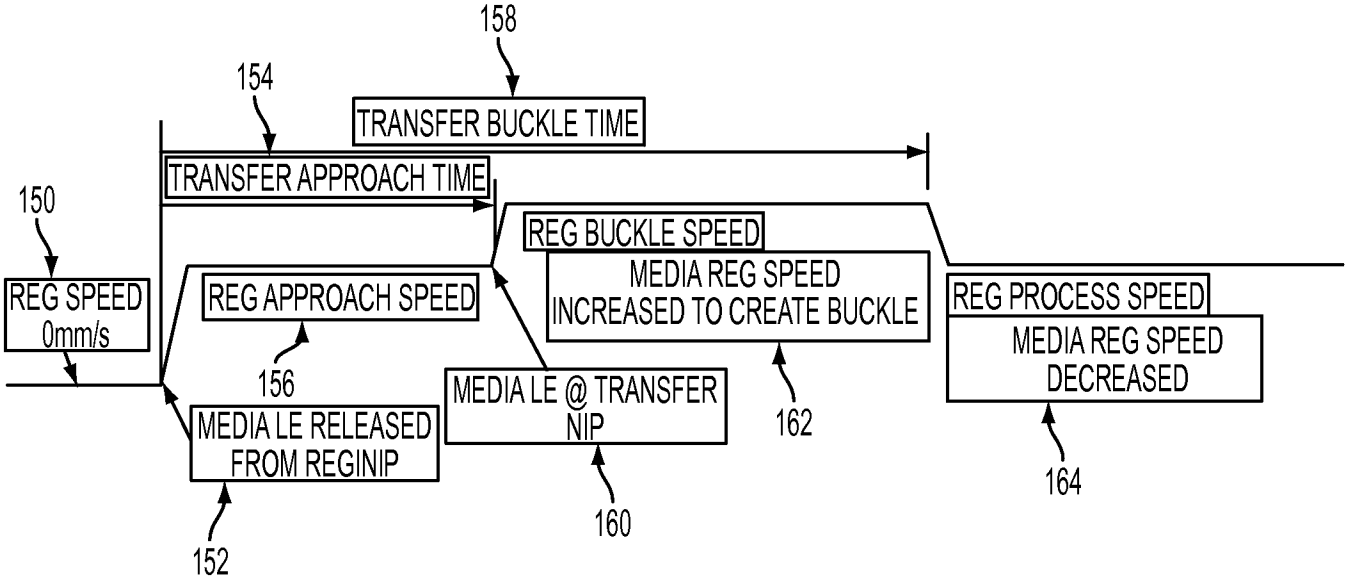
FIG. 7 is a schematic timing and speed diagram of a registration roller herein.

FIG. 7 is a schematic timing and speed diagram of a registration roller herein. More specifically, item 150 represents the powered registration roller, which will be arbitrarily identified as item 112 for this example, at rest (e.g., having a RegSpeed of 0 mm/s). Item 152 is the time at which the leading edge 106 of the sheet of media 102 passes through the registration nip 110 (e.g., the Media LE is released from the RegNip). This point in time (152) begins the transfer/approach time 154 and the transfer buckle time 158. The transfer approach time 154 is the time that the leading edge 106 of the sheet of media 102 takes to travel from the registration nip 110 to the transfer nip 120. During the transfer approach time 154, the registration roller 112 is rotating at a first speed that is greater than zero (greater than item 150) that is identified in FIG. 7 as the registration approach speed 156 (e.g., the RegApproachSpeed).

The transfer buckle time 158 is the period beginning at point 152 and continuing until the buckle is fully formed in the sheet of media 102. Beginning when the leading edge 106 of the sheet of media 102 enters the transfer nip 120 at item 160 (Media LE @ Transfer Nip) during the last part of the transfer buckle time 158, the speed of the registration roller 112 is increased to a second speed 162 (e.g., RegBuckleSpeed) that is greater than the first speed (greater than the registration approach speed 156). Note that during the last part of the transfer buckle time 158, the rollers of the transfer nip are rotating at the registration approach speed 156, to allow the buckle to be formed in the sheet of media. Once the buckle is fully formed at the end of item 158, the speed of the registration roller 112 is decreased back down to the registration approach speed 156. Note that the transfer buckle time 158 begins at the same time the transfer approach time 154 begins for convenience of timing; however, the transfer buckle time 158 could begin at time 160 and only measure the actual time that the buckle is formed. Additionally, the registration process speed 164 (RegProcessSpeed) can be the same or different from speed 154 (RegApproachSpeed) if required to cope with system variations, but is set to maintain the buckle once formed. Speed 164 is maintained by the registration roller 112 until the trailing edge 104 of the sheet of media exits the registration nip 110.

Figure 8:
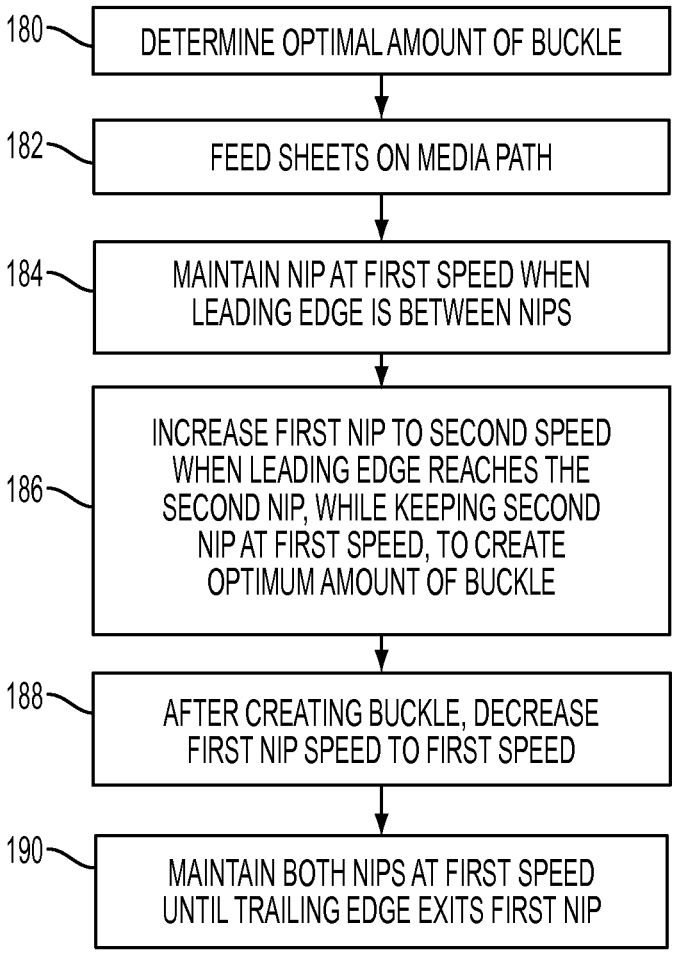
FIG. 8 is a flow diagram of various methods herein.

FIG. 8 is flowchart illustrating exemplary methods herein. As noted above, methods herein increase the sheet feeding speed of only the registration nip for only a portion of the time when the sheet is simultaneously held by both nips to first create and then maintain a previously established optimum amount of buckle in the sheet. This "optimum" amount of buckle, is determined by the methods herein empirically or through modeling, as shown in item 180, so that the amount of buckle that will minimize registration drive frequency effects caused by excess tension in the sheet, while at the same time minimizing image defects that result from vibrations in the sheet caused by excess buckle in the sheet.

In item 182, these methods feed the sheets of media along the sheet path to the printing engine. For example, the registration nip removes skew to properly align the sheet edges parallel to the sheet path, and the transfer nip transfers marking material to the sheets of media. The distance between the registration nip and the transfer nip is less than the length(s) of sheets the sheet path is designed to accommodate, which results in the sheets of media being simultaneously driven by the registration nip and the transfer nip at certain times when the sheets are traveling along sheet path.

These methods control the sheet feeding speeds of the registration nip and the transfer nip, using a speed control circuit. More specifically, these methods feed a sheet of media from the registration nip to the transfer nip along the sheet path and, in item 184, maintain the registration nip and the transfer nip at a first sheet feeding speed when the leading edge of the sheet of media is between the registration nip and the transfer nip (using the speed control circuit).

However, in item 186, these methods create (and maintain) a specific amount of buckle in the sheet of media by first increasing the sheet feeding speed of the registration nip to a second sheet feeding speed, while maintaining the transfer nip at the first sheet feeding speed, during a first portion of when the sheet of media is simultaneously within the registration nip and the transfer nip, using the speed control circuit. Then, in item 188, after creating the desired amount of buckle in the sheet of media, these methods decrease the sheet feeding speed of the registration nip back to the first sheet feeding speed, using the speed control circuit. Further, as shown in item 190, these methods maintain both the registration nip and the transfer nip at the first sheet feeding speed during the remaining portion of when the sheet of media is simultaneously within the registration nip and the transfer nip (e.g., until the trailing edge of the sheet of media exits the registration nip) so as to maintain that specific amount of buckle in the sheet of media during the full amount of the remaining portion of when the sheet of media is simultaneously within the registration nip and the transfer nip, again using the speed control circuit.

Figure 9:
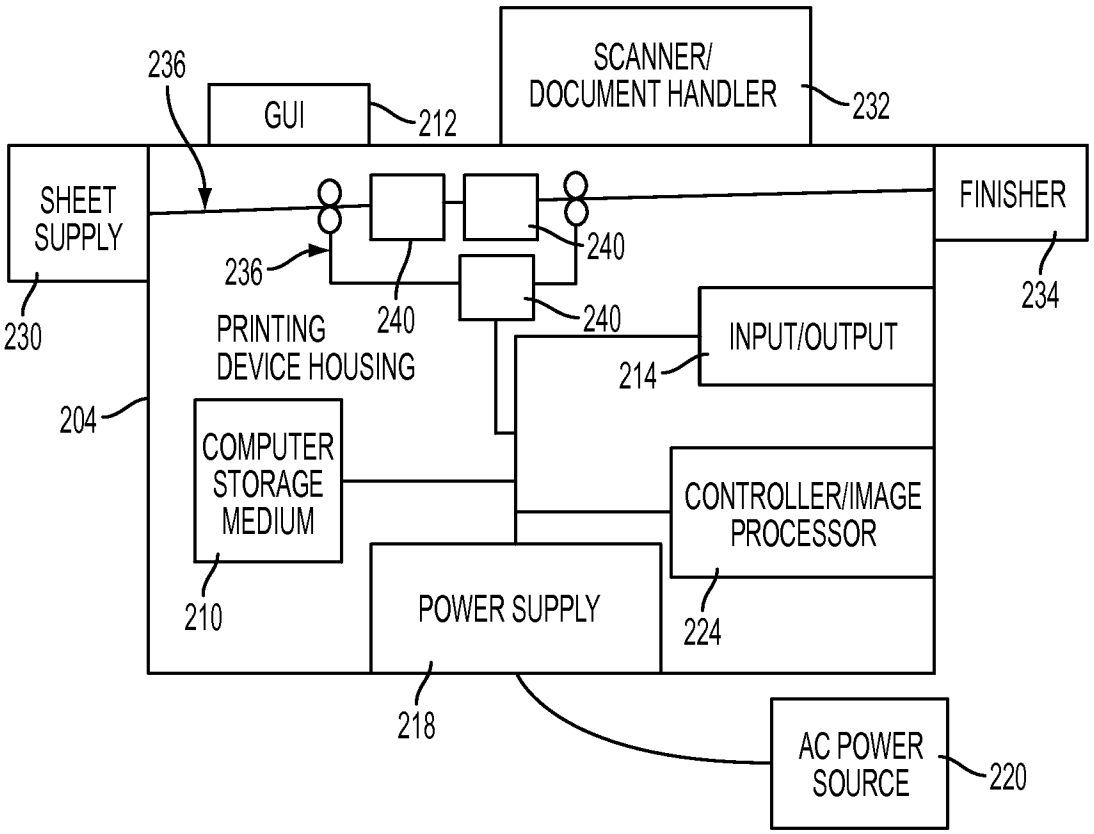
FIG. 9 is a schematic diagram illustrating devices herein.

FIG. 9 illustrates a computerized device that is a printing device 204, which can be used with devices and methods herein and can comprise, for example, a printer, copier, multi-function machine, multi-function device (MFD), etc. The printing device 204 includes a communications port (input/output) 214 operatively connected to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). A specialized image processor 224 (that is different from a general purpose computer because it is specialized for processing image data and controlling internal components of a printing device, such as the speed of nips, etc.) controls the various actions of the computerized device. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 9, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 operatively connected to the specialized image processor 224, a media path 236 positioned to supply sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

Figure 10:
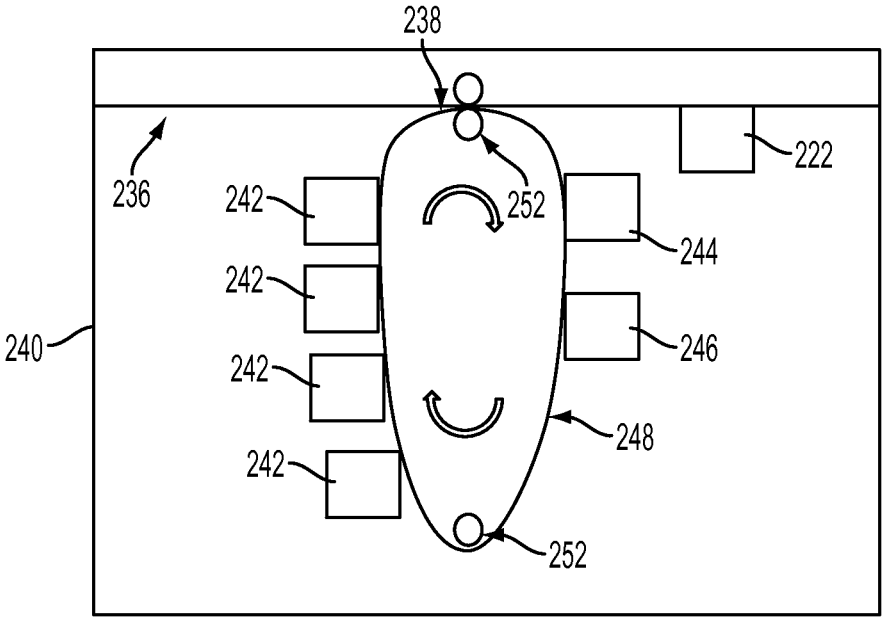
FIG. 10 is a schematic diagram illustrating devices herein.
Figure 11:
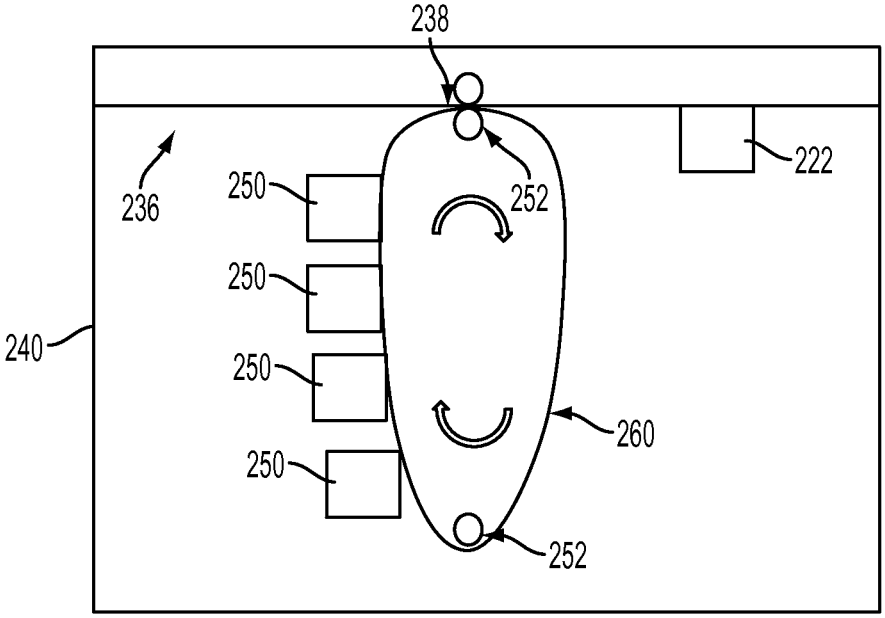
FIG. 11 is a schematic diagram illustrating devices herein.

The one or more printing engines 240 are intended to illustrate any marking device that applies a marking material (toner, inks, etc.) to sheets of media, whether currently known or developed in the future and can include, for example, devices that use a photoreceptor belt 248 (as shown in FIG. 10) or an intermediate transfer belt 258 (as shown in FIG. 11), or devices that print directly to print media (e.g., inkjet printers, ribbon-based contact printers, etc.).

More specifically, FIG. 10 illustrates one example of the above-mentioned printing engine(s) 240 that uses one or more (potentially different color) development stations 242 adjacent a photoreceptor belt 248 supported on rollers 252. In FIG. 10 an electronic or optical image or an image of an original document or set of documents to be reproduced may be projected or scanned onto a charged surface of the photoreceptor belt 248 using an imaging device (sometimes called a raster output scanner (ROS)) 246 to form an electrostatic latent image. Thus, the electrostatic image can be formed onto the photoreceptor belt 248 using a blanket charging station/device 244 (and item 244 can include a cleaning station or a separate cleaning station can be used) and the imaging station/device 246 (such as an optical projection device, e.g., raster output scanner). Thus, the imaging station/device 246 changes a uniform charge created on the photoreceptor belt 248 by the blanket charging station/device 244 to a patterned charge through light exposure, for example.

The photoreceptor belt 248 is driven (using, for example, driven rollers 252) to move the photoreceptor in the direction indicated by the arrows past the development stations 242, and a transfer station 238. Note that devices herein can include a single development station 242, or can include multiple development stations 242, each of which provides marking material (e.g., charged toner) that is attracted by the patterned charge on the photoreceptor belt 248. The same location on the photoreceptor belt 248 is rotated past the imaging station 246 multiple times to allow different charge patterns to be presented to different development stations 242, and thereby successively apply different patterns of different colors to the same location on the photoreceptor belt 248 to form a multi-color image of marking material (e.g., toner) which is then transferred to print media at the transfer station 238.

As is understood by those ordinarily skilled in the art, the transfer station 238 generally includes rollers and other transfer devices. Further, item 222 represents a fuser device that is generally known by those ordinarily skilled in the art to include heating devices and/or rollers that fuse or dry the marking material to permanently bond the marking material to the print media.

Thus, in the example shown in FIG. 10, which contains four different color development stations 242, the photoreceptor belt 248 is rotated through four revolutions in order to allow each of the development stations 242 to transfer a different color marking material (where each of the development stations 242 transfers marking material to the photoreceptor belt 248 during a different revolution). After all such revolutions, four different colors have been transferred to the same location of the photoreceptor belt, thereby forming a complete multi-color image on the photoreceptor belt, after which the complete multi-color image is transferred to print media, traveling along the media path 236, at the transfer station 238.

Alternatively, printing engine(s) 240 shown in FIG. 9 can utilize one or more potentially different color marking stations 250 and an intermediate transfer belt (ITB) 260 supported on rollers 252, as shown in FIG. 11. The marking stations 250 can be any form of marking station, whether currently known or developed in the future, such as individual electrostatic marking stations, individual inkjet stations, individual dry ink stations, etc. Each of the marking stations 250 transfers a pattern of marking material to the same location of the intermediate transfer belt 260 in sequence during a single belt rotation (potentially independently of a condition of the intermediate transfer belt 260) thereby, reducing the number of passes the intermediate transfer belt 260 must make before a full and complete image is transferred to the intermediate transfer belt 260.

Figure 12:
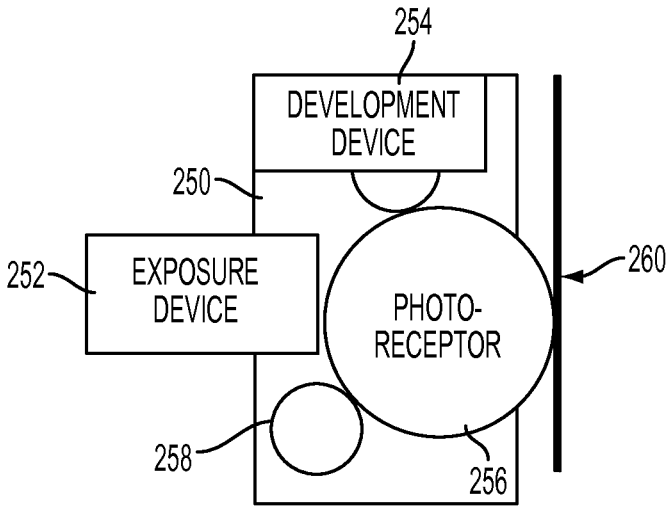
FIG. 12 is a schematic diagram illustrating devices herein.

One exemplary individual electrostatic marking station 250 is shown in FIG. 12 positioned adjacent to (or potentially in contact with) intermediate transfer belt 260. Each of the individual electrostatic marking stations 250 includes its own charging station 258 that creates a uniform charge on an internal photoreceptor 256, an internal exposure device 252 that patterns the uniform charge, and an internal development device 254 that transfers marking material to the photoreceptor 256. The pattern of marking material is then transferred from the photoreceptor 256 to the intermediate transfer belt 260 and eventually from the intermediate transfer belt to the marking material at the transfer station 238.

While FIGS. 10 and 11 illustrate four marking stations 242, 250 adjacent or in contact with a rotating belt (248, 260), which is useful with systems that mark in four different colors such as, red, green, blue (RGB), and black; or cyan, magenta, yellow, and black (CMYK), as would be understood by those ordinarily skilled in the art, such devices could use a single marking station (e.g., black) or could use any number of marking stations (e.g., 2, 3, 5, 8, 11, etc.).

Thus, in printing devices herein a latent image can be developed with developing material to form a toner image corresponding to the latent image. Then, a sheet is fed from a selected paper tray supply to a sheet transport for travel to a transfer station. There, the image is transferred to a print media material, to which it may be permanently fixed by a fusing device. The print media is then transported by the sheet output transport 236 to output trays or a multi-function finishing station 234 performing different desired actions, such as stapling, hole-punching and C or Z-folding, a modular booklet maker, etc., although those ordinarily skilled in the art would understand that the finisher/output tray 234 could comprise any functional unit.

As would be understood by those ordinarily skilled in the art, the printing device 204 shown in FIG. 9 is only one example and the devices and methods herein are equally applicable to other types of printing devices that may include fewer components or more components. For example, while a limited number of printing engines and media paths are illustrated in FIG. 9, those ordinarily skilled in the art would understand that many more media paths and additional printing engines could be included within any printing device used with devices and methods herein.

While some exemplary structures are illustrated in the attached drawings, where like numbers identify the same or similar items, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the devices and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The devices and methods herein can encompass devices and methods that print in color, monochrome, or handle color or monochrome image data. All foregoing devices and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices and methods herein cannot be implied or imported from any above example as limitations to any particular order, number, position, size, shape, angle, color, or material.

What is claimed is:

1. An apparatus comprising:

a sheet path;

a first nip at a first location of said sheet path;

a second nip at a second location of said sheet path; and a speed control circuit controlling sheet feeding speeds of said first nip and said second nip, said first nip feeding a sheet of media to said second nip along said sheet path, said speed control circuit maintaining said first nip and said second nip at a first sheet feeding speed when a leading edge of said sheet of media is between said first nip and said second nip, said speed control circuit creating an amount of buckle in said sheet of media by increasing a sheet feeding speed of said first nip to a second sheet feeding speed while maintaining said second nip at said first sheet feeding speed during a first portion of when said sheet of media is simultaneously within said first nip and said second nip, said speed control circuit decreasing said sheet feeding speed of said first nip to said first sheet feeding speed after creating said amount of buckle in said sheet of media, said speed control circuit maintaining said first nip and said second nip at said first sheet feeding speed during a remaining portion of when said sheet of media is simultaneously within said first nip and said second nip to maintain said amount of buckle in said sheet of media during said remaining portion of when said sheet of media is simultaneously within said first nip and said second nip, and said remaining portion of when said sheet of media is simultaneously within said first nip and said second nip occurring from when said creating an amount of buckle in said sheet of media is complete until a trailing edge of said sheet of media exits said first nip.

2. The apparatus according to claim 1, said amount of buckle in said sheet being previously established to minimize registration drive frequency effects caused by excess tension in said sheet and minimize image defects resulting from vibrations in said sheet caused by excess buckle in said sheet.

3. The apparatus according to claim 1, a distance between said first nip and said second nip being less than a length of said sheet of media.

4. The apparatus according to claim 1, said second nip transferring marking material to said sheet of media.

5. The apparatus according to claim 1, said first nip comprising a registration nip aligning said sheet of media along said sheet path.

6. A printing apparatus comprising:

a printing engine;

a sheet path feeding sheets of media to said printing engine, said sheet path comprising a registration nip at a first location of said sheet path, and a transfer nip at a second location of said sheet path; and a speed control circuit controlling sheet feeding speeds of said registration nip and said transfer nip, said registration nip feeding a sheet of media to said transfer nip along said sheet path, said speed control circuit maintaining said registration nip and said transfer nip at a first sheet feeding speed when a leading edge of said sheet of media is between said registration nip and said transfer nip, said speed control circuit creating an amount of buckle in said sheet of media by increasing a sheet feeding speed of said registration nip to a second sheet feeding speed while maintaining said transfer nip at said first sheet feeding speed during a first portion of when said sheet of media is simultaneously within said registration nip and said transfer nip, said second sheet feeding speed being greater than said first sheet feeding speed, said speed control circuit decreasing said sheet feeding speed of said registration nip to said first sheet feeding speed after creating said amount of buckle in said sheet of media, said speed control circuit maintaining said registration nip and said transfer nip at said first sheet feeding speed during a remaining portion of when said sheet of media is simultaneously within said registration nip and said transfer nip to maintain said amount of buckle in said sheet of media during said remaining portion of when said sheet of media is simultaneously within said registration nip and said transfer nip, and said remaining portion of when said sheet of media is simultaneously within said registration nip and said transfer nip occurring from when said creating an amount of buckle in said sheet of media is complete until a trailing edge of said sheet of media exits said registration nip.

7. The printing apparatus according to claim 6, said amount of buckle in said sheet being previously established to minimize registration drive frequency effects caused by excess tension in said sheet and minimize image defects resulting from vibrations in said sheet caused by excess buckle in said sheet.

8. The printing apparatus according to claim 6, a distance between said registration nip and said transfer nip being less than a length of said sheet of media.

9. The printing apparatus according to claim 6, said buckle preventing said sheet from being stretched between said registration nip and said transfer nip.

10. The printing apparatus according to claim 6, said registration nip aligning said sheet of media along said sheet path.

11. A method comprising:

maintaining a first nip and a second nip at a first sheet feeding speed when a leading edge of a sheet of media is between said first nip and said second nip, using a speed control circuit;

creating an amount of buckle in said sheet of media by increasing a sheet feeding speed of said first nip to a second sheet feeding speed while maintaining said second nip at said first sheet feeding speed during a first portion of when said sheet of media is simultaneously within said first nip and said second nip, using said speed control circuit;

decreasing said sheet feeding speed of said first nip to said first sheet feeding speed after creating said amount of buckle in said sheet of media, using said speed control circuit; and maintaining said first nip and said second nip at said first sheet feeding speed during a remaining portion of when said sheet of media is simultaneously within said first nip and said second nip to maintain said amount of buckle in said sheet of media during said remaining portion of when said sheet of media is simultaneously within said first nip and said second nip, using said speed control circuit, said remaining portion of when said sheet of media is simultaneously within said first nip and said second nip occurring from when said creating an amount of buckle in said sheet of media is complete until a trailing edge of said sheet of media exits said first nip.

12. The method according to claim 11, further comprising determining said amount of buckle in said sheet by minimizing registration drive frequency effects caused by excess tension in said sheet and minimizing image defects resulting from vibrations in said sheet caused by excess buckle in said sheet.

13. The method according to claim 11, a distance between said first nip and said second nip being less than a length of said sheet of media.

14. The method according to claim 11, said creating an amount of buckle preventing said sheet from being stretched between said first nip and said second nip.

15. The method according to claim 11, further comprising aligning said sheet of media using said first nip.

16. A method comprising:

feeding sheets of media along a sheet path to a printing engine, said printing engine comprising a registration nip at a first location of said sheet path, and a transfer nip at a second location of said sheet path;

controlling sheet feeding speeds of said registration nip and said transfer nip, using a speed control circuit;

feeding a sheet of media from said registration nip to said transfer nip along said sheet path;

maintaining said registration nip and said transfer nip at a first sheet feeding speed when a leading edge of said sheet of media is between said registration nip and said transfer nip, using said speed control circuit;

creating an amount of buckle in said sheet of media by increasing a sheet feeding speed of said registration nip to a second sheet feeding speed and maintaining said transfer nip at said first sheet feeding speed during a first portion of when said sheet of media is simultaneously within said registration nip and said transfer nip, using said speed control circuit, said second sheet feeding speed being greater than said first sheet feeding speed;

decreasing said sheet feeding speed of said registration nip to said first sheet feeding speed after creating said amount of buckle in said sheet of media, using said speed control circuit; and maintaining said registration nip and said transfer nip at said first sheet feeding speed during a remaining portion of when said sheet of media is simultaneously within said registration nip and said transfer nip to maintain said amount of buckle in said sheet of media during said remaining portion of when said sheet of media is simultaneously within said registration nip and said transfer nip, using a speed control circuit, said remaining portion of when said sheet of media is simultaneously within said registration nip and said transfer nip occurring from when said creating an amount of buckle in said sheet of media is complete until a trailing edge of said sheet of media exits said registration nip.

17. The method according to claim 16, further comprising determining said amount of buckle in said sheet by minimizing registration drive frequency effects caused by excess tension in said sheet and minimizing image defects resulting from vibrations in said sheet caused by excess buckle in said sheet.

18. The method according to claim 16, a distance between said registration nip and said transfer nip being less than a length of said sheet of media.

19. The method according to claim 16, said creating an amount of buckle preventing said sheet from being stretched between said registration nip and said transfer nip.

20. The method according to claim 16, further comprising aligning said sheet of media along said sheet path, using said registration nip.

* * * * *